US005549458A

United States Patent [19]

Chapman et al.

[11] Patent Number: 5,549,458

[45] Date of Patent: Aug. 27, 1996

[54] PERISTALTIC PUMP WITH QUICK RELEASE ROTOR HEAD ASSEMBLY

[75] Inventors: Arthur S. Chapman, Solvang, Calif.; Richard L. Afflerbaugh, Libertyville, Ill.

[73] Assignee: Baxter International Inc., Deerfield, Ill.

[21] Appl. No.: 269,934

[22] Filed: Jul. 1, 1994

[51] Int. Cl.[6] ..... F04B 43/08

[52] U.S. Cl. ..... 417/360; 417/477.8

[58] Field of Search ..... 417/360, 477.8, 417/477.7, 477.1

[56] References Cited

U.S. PATENT DOCUMENTS

| | | | |
|---|---|---|---|
| 4,205,948 | 6/1980 | Jones . | |
| 4,211,519 | 7/1980 | Hogan . | |
| 4,500,269 | 2/1985 | Jess . | |
| 4,515,535 | 5/1985 | D'Silva . | |
| 4,527,323 | 7/1985 | Dawson . | |
| 4,548,553 | 10/1985 | Ferster | 417/477.8 X |
| 4,558,996 | 12/1985 | Becker . | |
| 4,568,255 | 2/1986 | Lavender et al. | 417/477.8 |
| 4,599,055 | 7/1986 | Dykstra . | |
| 4,673,334 | 6/1987 | Allington et al. . | |
| 4,674,962 | 6/1987 | Gardineer . | |
| 4,705,464 | 11/1987 | Arimond | 417/477.8 X |
| 4,720,249 | 1/1988 | Krebs | 417/477.8 |
| 4,798,590 | 1/1989 | O'Leary et al. . | |
| 4,824,339 | 4/1989 | Bainbridge et al. . | |
| 5,044,902 | 9/1991 | Malbec . | |
| 5,356,267 | 10/1994 | Fulmen | 417/360 X |
| 5,427,509 | 6/1995 | Chapman et al. . | |
| 5,462,417 | 10/1995 | Chapman . | |

FOREIGN PATENT DOCUMENTS

WO93/22560 11/1993 WIPO .

*Primary Examiner*—Richard E. Gluck

*Attorney, Agent, or Firm*—Daniel D. Ryan; Bradford R. L. Price; Joseph B. Barrett

[57] ABSTRACT

A peristaltic pumping apparatus includes a pump rotor carrying a roller and a drive mechanism for rotating the rotor. The drive mechanism includes a carrier for holding the pump rotor. The apparatus includes a release pin mechanism carried on the pump rotor and exposed to access by a user. The release pin mechanism is movable by the user between a first position that connects the pump rotor to the carrier and a second position that disconnects the pump rotor from the carrier. Placing the release pin mechanism in the second position allows quick separation of the pump rotor from the drive mechanism.

4 Claims, 9 Drawing Sheets

Fig. 1B
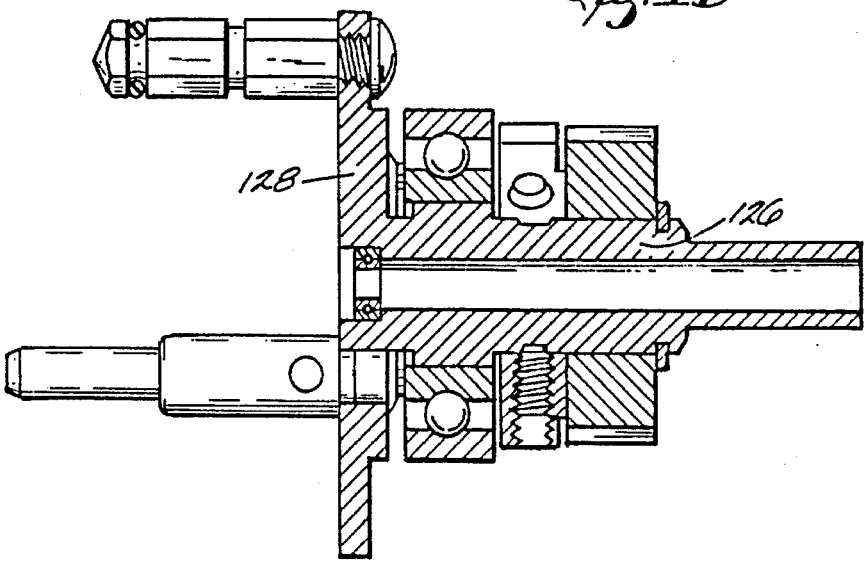
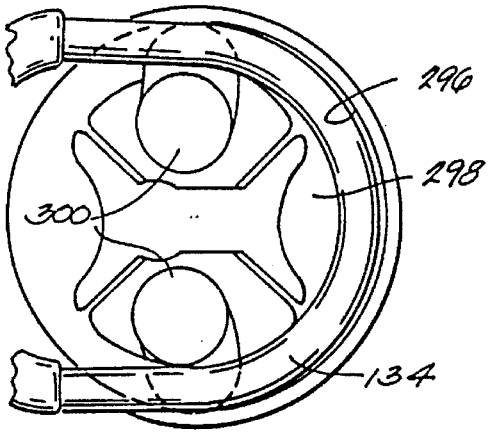
Fig. 2.
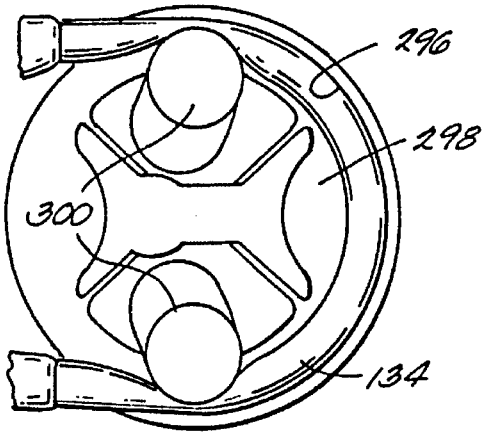
Fig. 3

9
292
298
136
144
138
152
148
140
308
300
130
9

300
134
298
292
300

152
136
144
298
300
138
148
308
130
140
292
310
330
332
352
336
PNEUMATIC
PRESSURE 298
130
152
136
300
308
336
334
330
PNEUMATIC
PRESSURE
292
310

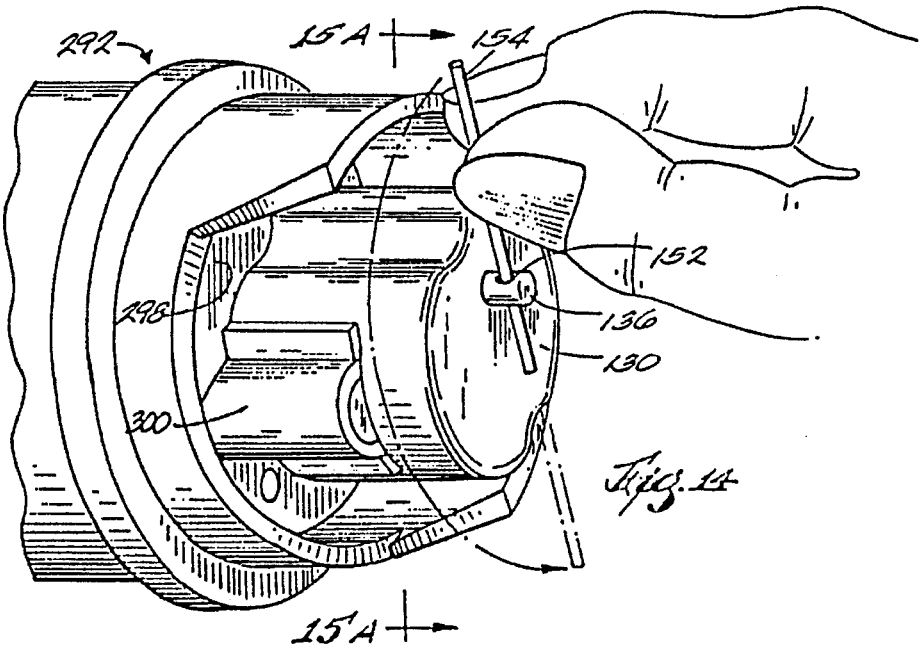
Fig. 14
Fig. 15A
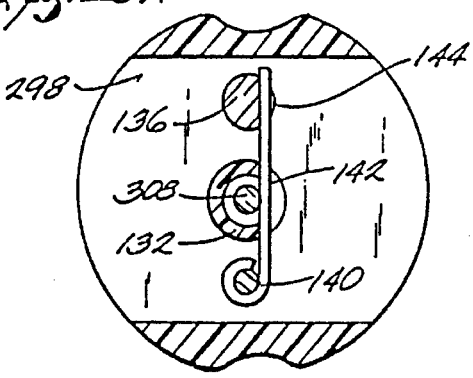
Fig. 15B
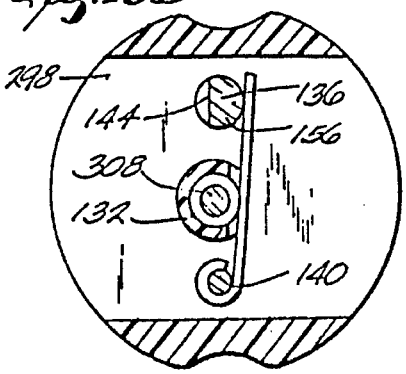
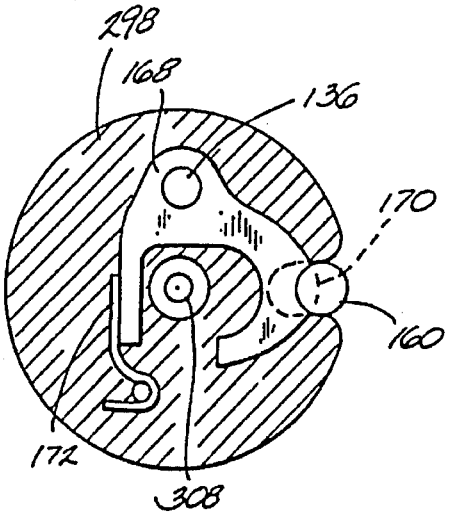
Fig. 16A
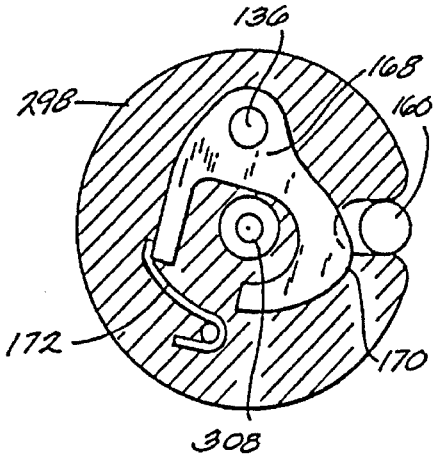
Fig. 16B

PERISTALTIC PUMP WITH QUICK RELEASE ROTOR HEAD ASSEMBLY

FIELD OF THE INVENTION

The invention relates to peristaltic pumps.

BACKGROUND OF THE INVENTION

Peristaltic pumping mechanisms are well know.

In the unlikely event that tubing associated with the pumping mechanism rupture or leak, it is necessary to remove the contaminated or liquid damaged components of the mechanism for repair or replacement.

A need exists for a release mechanism that allows the pump rotor component of a peristaltic pump to be separated from the drive train component quickly and simply.

SUMMARY OF THE INVENTION

One aspect of the invention provides a peristaltic pumping apparatus comprising a peristaltic pumping element including a pump rotor carrying a roller and a drive mechanism for rotating the rotor. The drive mechanism includes a carrier for holding the pump rotor. The apparatus includes a release pin mechanism carried on the pump rotor and exposed to access by a user. The release pin mechanism is movable by the user between a first position that connects the pump rotor to the carrier and a second position that disconnects the pump rotor from the carrier. Placing the release pin mechanism in the second position allows quick separation of the pump rotor from the drive mechanism.

Another aspect of the invention provides a peristaltic pumping apparatus comprising a peristaltic pumping element including a pump rotor carrying a roller and a drive mechanism for rotating the rotor. The drive mechanism includes a carrier for holding the pump rotor. The apparatus further includes a roller locating mechanism for moving the pump roller between a retracted position inside the pump rotor and an extended position at least partially outside the pump rotor. The apparatus includes a release pin mechanism carried on the pump rotor and exposed to access by a user. The release pin mechanism is movable by the user between a first position that connects the pump rotor to the carrier and to the roller locating mechanism and a second position that simultaneously disconnects the pump rotor from both the carrier and the roller locating mechanism. Placing the release pin mechanism in the second position allows quick separation of the pump rotor from the drive mechanism and the roller locating mechanism.

In a preferred embodiment, the release pin mechanism rotates between its first and second positions.

The features and advantages of the invention will become apparent from the following description, the drawings, and the claims.

BRIEF DESCRIPTION OF THE DRAWINGS

FIG. 1B is a side section view of the carrier for holding the pump rotor assembly of the pump shown in FIG. 1;

FIG. 2 is a top view of the pump rotor assembly with its rollers retracted;

FIG. 3 is a top view of the pump rotor assembly with its roller extended for use;

FIG. 14 is a perspective view of the operation of the release bar to separate or attach the pump rotor assembly to the pump;

FIGS. 15A and 15B are top views showing the operation of the release bar in securing or freeing the rotor assembly from the linear actuator mechanism for locating the rollers; and FIGS. 16A and 16B are top views showing the operation of the release bar in securing or freeing the rotor assembly from the drive train of the pump.

The invention may be embodied in several forms without departing from its spirit or essential characteristics. The scope of the invention is defined in the appended claims, rather than in the specific description preceding them. All embodiments that fall within the meaning and range of equivalency of the claims are therefore intended to be embraced by the claims.

DESCRIPTION OF THE PREFERRED EMBODIMENTS

Figure 1A:
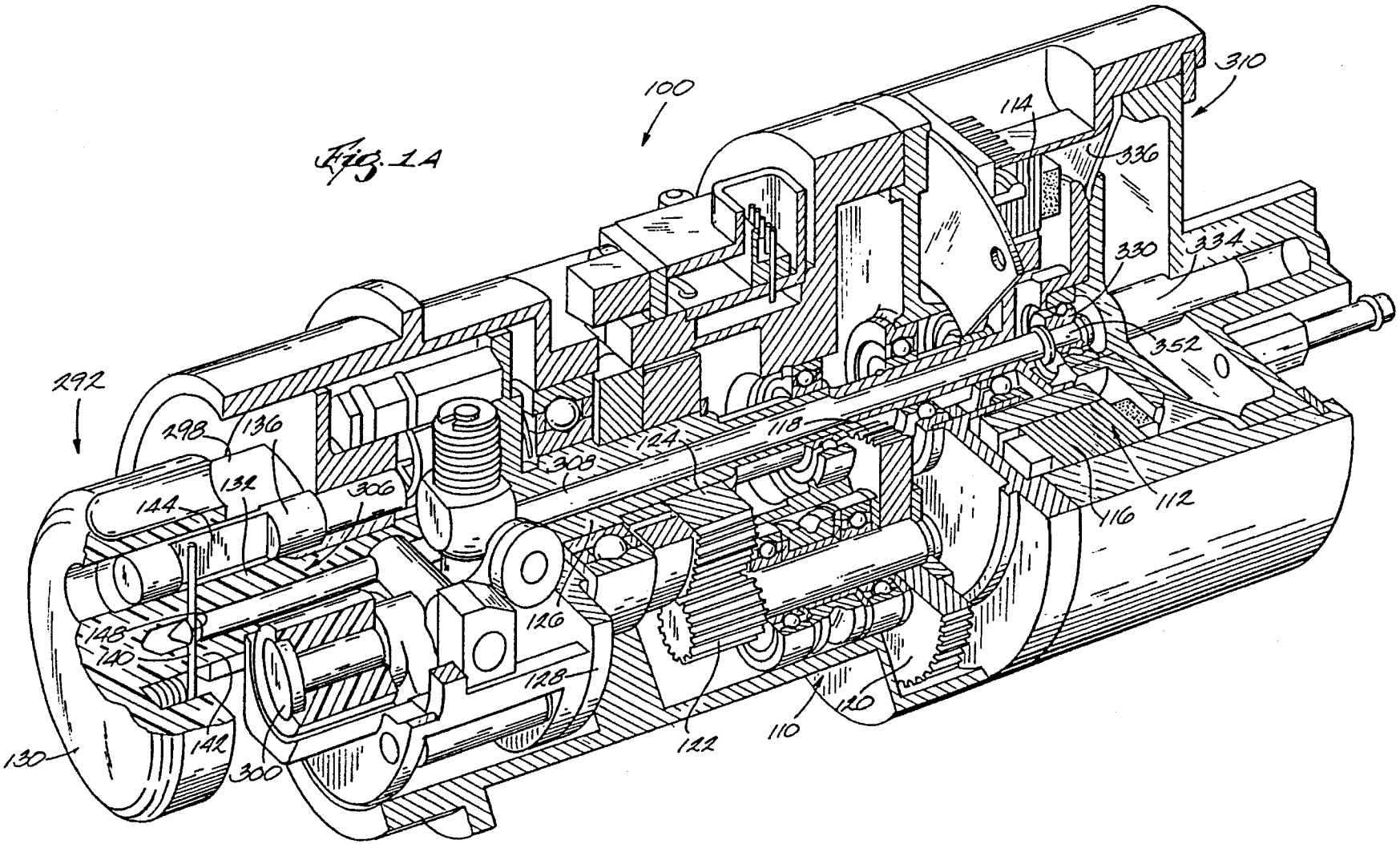
FIG. 1A is a side section perspective view of a peristaltic pump that embodies the features of the invention.

FIG. 1A shows a peristaltic pump 100 that embodies the features of the invention.

The pump 100 includes a drive train assembly 110, which is mechanically coupled to a rotor assembly 292.

The pump 100 can be used for processing various fluids. The pump 100 is particularly well suited for processing whole blood and other suspensions of biological cellular materials.

The drive train assembly 110 includes a motor 112. Various types of motors can be used. In the illustrated and preferred embodiment, the motor 112 is a brushless D.C. motor having a stator 114 and a rotor 116.

The drive train assembly 110 further includes a pinion gear 118 attached to the rotor 116 of the motor 112. The pinion gear 118 mates with an intermediate gear 120, which is in turn coupled to a torque gear 124 via another pinion gear 122. The torque gear 124 and rotor pinion gear 118 are aligned along a common rotational axis. As will be explained in greater detail later, this allows the passage of a concentric actuating rod 308 along the rotational axis.

The torque gear 124 is attached to a carrier shaft 126, the distal end of which includes a carrier 128 (see FIG. 1A also) for the rotor assembly 292.

The rotor assembly 292 includes a rotor 298 that rotates about the rotational axis. The rotor assembly 292 carries a pair of diametrically spaced rollers 300 (see FIGS. 2 and 3). In use, as FIG. 3 best shows, the rollers 300 engage flexible tubing 134 against an associated pump race 296. Rotation of the rotor 298 causes the rollers 300 to press against and urge fluid through the tubing 134. This peristaltic pumping action is well known.

The rotor assembly 292 also includes a roller locating assembly 306. The locating assembly 306 moves the pump rollers 300 radially of the axis of rotation. The rollers 300 move between a retracted position within the associated pump rotor 298 (as FIG. 2 shows) and an extended position outside the associated pump rotor 298 (as FIG. 3 shows).

When retracted (see FIG. 2), the rollers 300 make no contact with the tubing 134 within the race 296 as the rotor 298 rotates. When extended (see FIG. 3), the rollers 300 contact the tubing 134 within the race 296 to pump fluid in the manner just described.

The roller locating assembly 306 may be variously constructed. In the illustrated and preferred embodiment (see FIGS. 4A and 4B), the assembly 306 includes an external gripping handle 130 that extends from the rotor 298. As FIGS. 4A and B show, the gripping handle 130 includes a center shaft 132 that fits within a bore 134 in the rotor 298. The bore 134 is aligned with the rotational axis of the assembly 292.

Figure 4A:
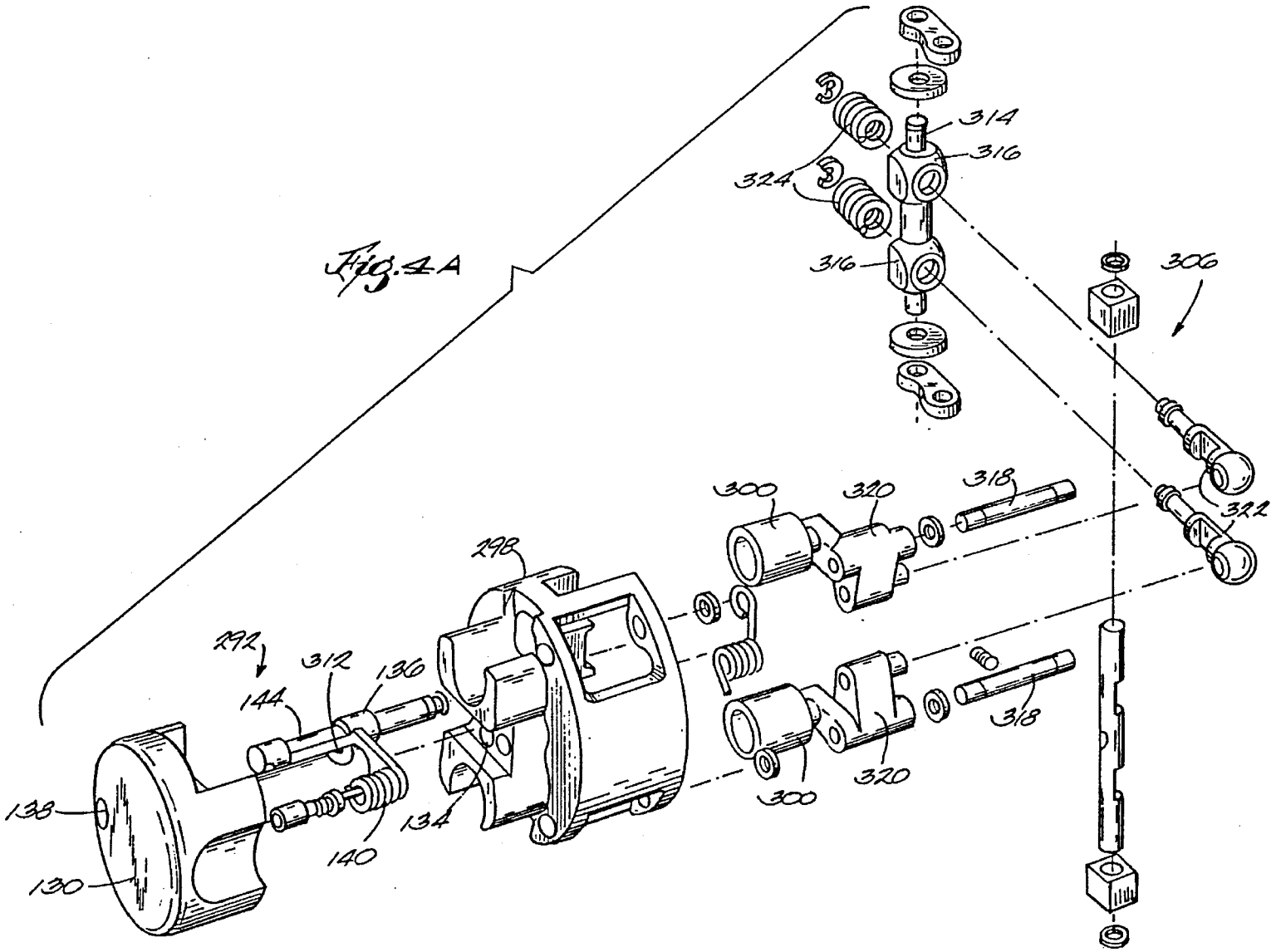
FIG. 4A is an exploded perspective view of the pump rotor assembly.
Figure 4B:
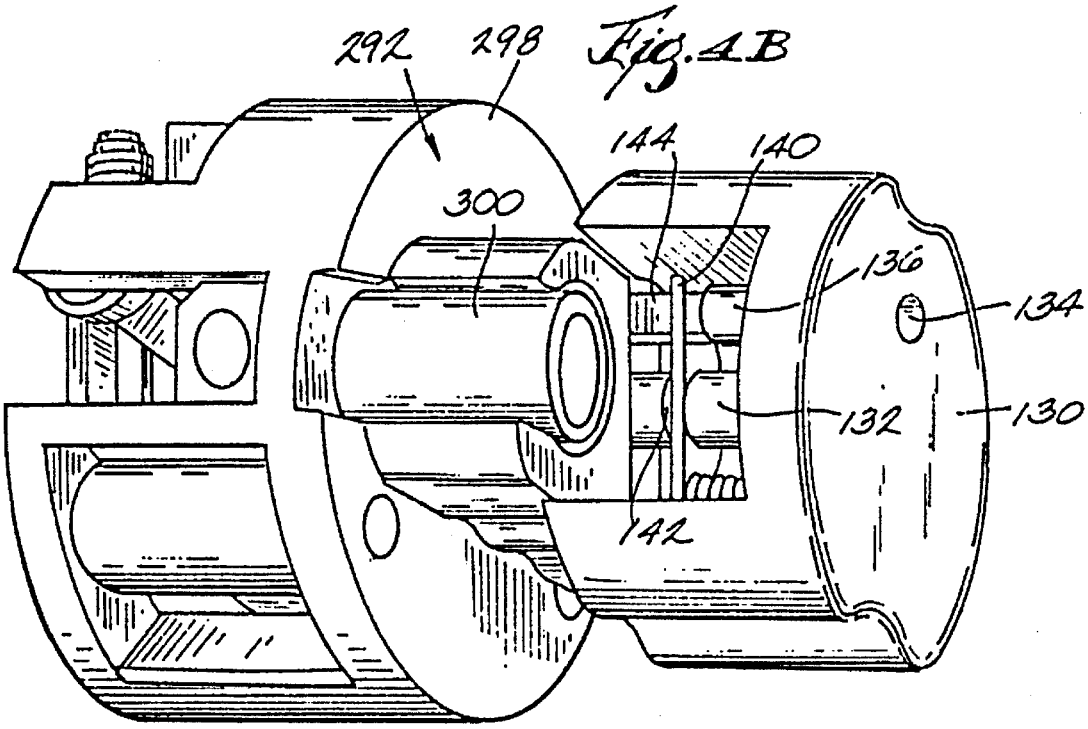
FIG. 4B is a perspective view of the pump rotor assembly, when assembled and the associated handle moved outward to withdraw the rollers.
Figure 8:
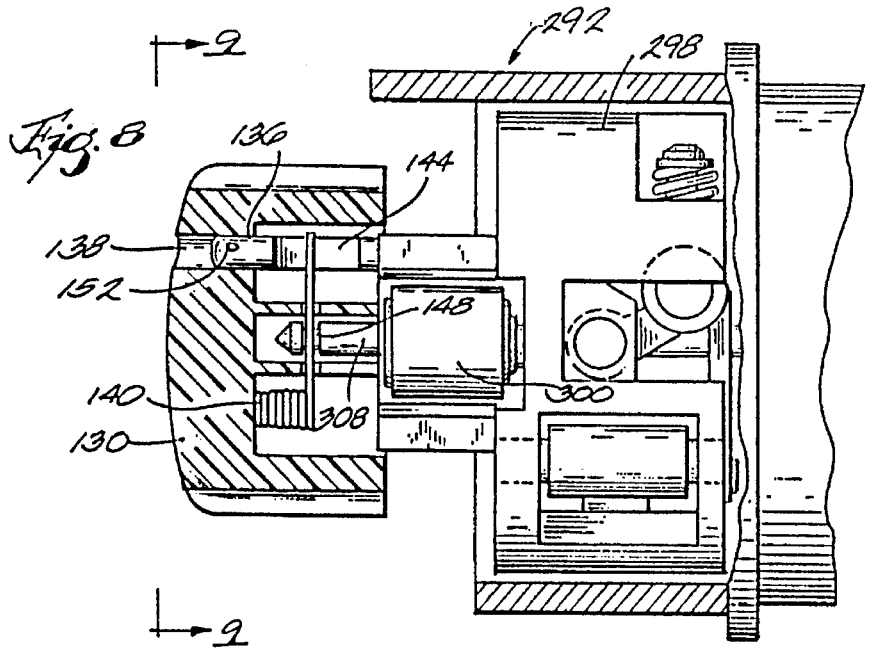
FIG. 8 is a side section view of the pump rotor assembly with the handle moved outward to retract the rollers.

A release bar 136 secured to the rotor 298 correspondingly sits within an off-center bore 138 in the handle 130. As FIGS. 4B and 8 show, a release spring 140 seated within the handle fits within a groove 142 in the handle shaft 132 and rests against a relieved surface 144 on the release bar 136 to attach the handle 130 to the rotor 298. Mutually supported by the shaft 132 and the release bar 136, and secured by the spanning release spring 140, the handle 130 rotates in common with the rotor 298. As FIGS. 6 and 8 also show, the handle 130 slides inward and outward with respect to the rotor 298.

Figure 5:
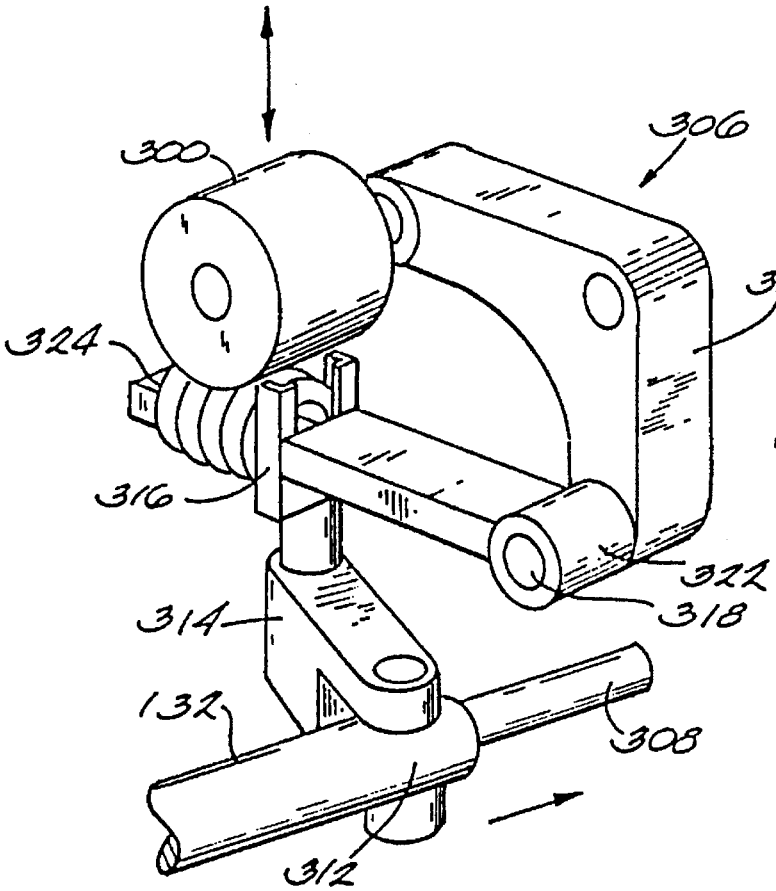
FIG. 5 is a perspective view of the roller locating mechanism of the pump rotor assembly in an assembled condition.

As FIG. 5 best shows, the end of the handle shaft 132 includes a first trunnion 312 within the rotor 298, which moves as the handle 130 slides along the axis of rotation (shown by the arrows A in FIG. 5). As FIGS. 4A and 5 show, a first link 314 couples the first trunnion 312 to a pair of second trunnions 316, one associated with each roller 300. In FIG. 5, only one of the second trunnions 316 is shown for the sake of illustration. The first link 314 displaces the second trunnions 316 in tandem in a direction generally transverse the path along which the first trunnion 312 moves (as shown by arrows B in FIG. 5). The second trunnions 316 thereby move in a path that is perpendicular to the axis of rotor rotation (that is, arrows B are generally orthogonal to arrows A in FIG. 5).

As FIGS. 4A and 5 also show, each pump roller 300 is carried by an axle 318 on a rocker arm 320. The rocker arms 320 are each, in turn, coupled by a second link 322 to the associated second trunnion 316.

Displacement of the second trunnions 316 toward the rocker arms 320 pivots the rocker arms 320 to move the rollers 300 in tandem toward their retracted positions (as shown by arrows C in FIG. 5).

Displacement of the second trunnions 316 away from the rocker arms 320 pivots the rocker arms 320 to move the rollers 300 in tandem toward their extended positions.

Springs 324 normally urge the second trunnions 316 toward the rocker arms 320. The springs 324 normally bias the rollers 300 toward their retracted positions.

Figure 6:
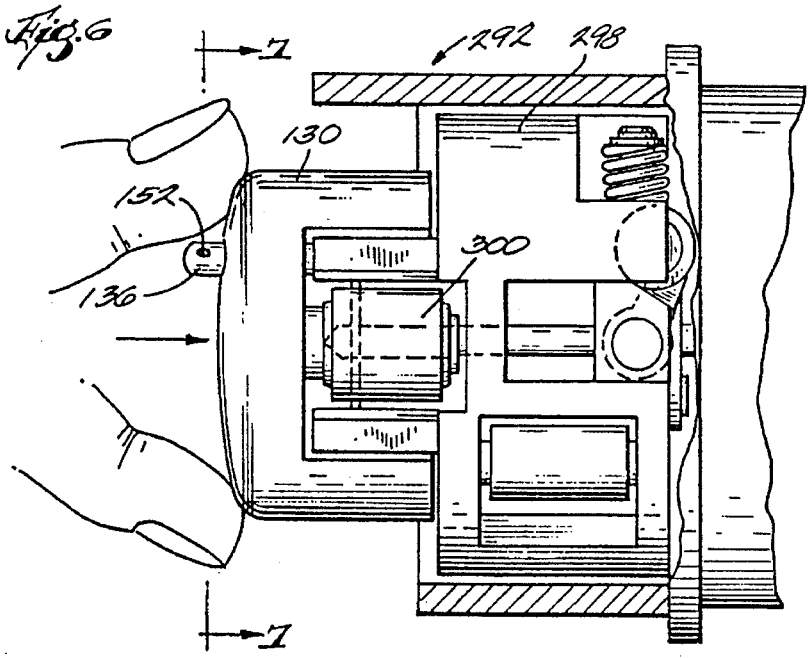
FIG. 6 is a side section view of the pump rotor assembly with the handle moved inward to extend the rollers.
Figure 7:
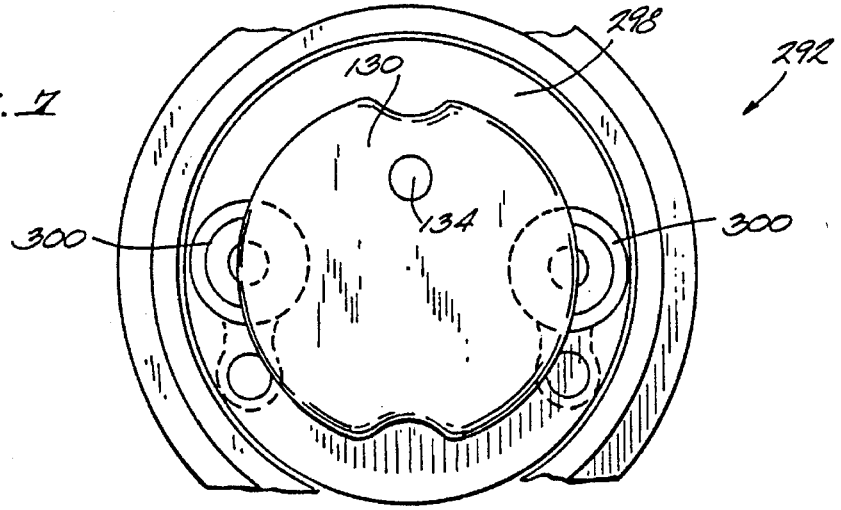
FIG. 7 is a top view of the pump rotor assembly with the rollers extended.
Figure 9:
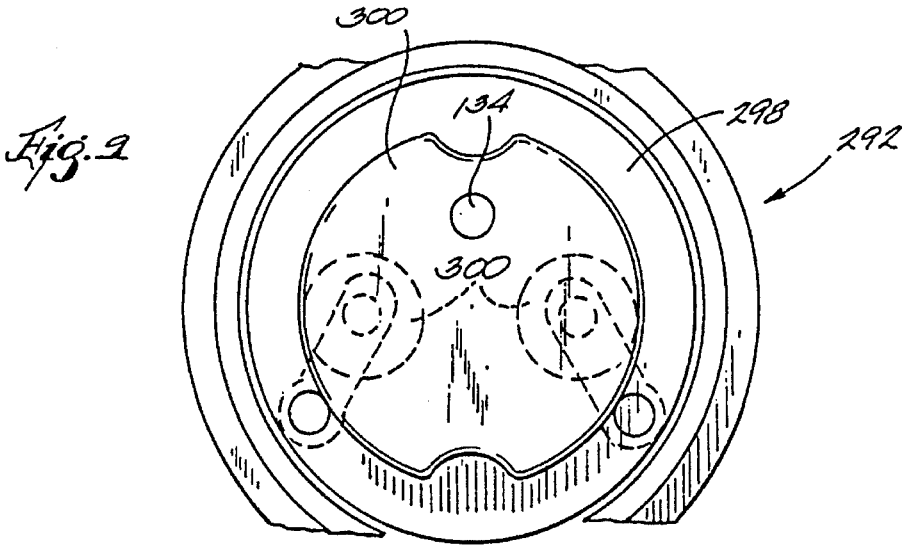
FIG. 9 is a top view of the pump rotor assembly with the rollers retracted.

In this arrangement, inward sliding movement of the handle 130 toward the rotor 298 (as FIGS. 6 and 7 show) displaces the second trunnions 316 against the action of the springs 324, pivoting the rocker arms 320 to move the rollers 300 into their extended positions. Outward sliding movement of the handle 130 away from the rotor 298 (as FIGS. 4B, 8, and 9 show) augments the spring-assisted return of the rollers 300 to their retracted positions.

The independent action of each spring 324 against its associated second trunnions 316 and links 314 places tension upon each individual pump roller 300 when in its extended position. Each roller 300 thereby independently accommodates, within the compression limits of its associated spring 324, for variations in the geometry and dimensions of the particular tubing 134 it engages. The independent tensioning of each roller 300 also accommodates other mechanical variances that may exist within the pump 10, again within the compression limits of its associated spring 324.

In the illustrated and preferred embodiment, the roller locating assembly 306 further includes an actuating rod 308 that extends through a bore 146 along the axis of rotation of the rotor 298. As FIG. 1 best shows, the proximal end of the actuating rod 308 is coupled to a linear actuator 310. The actuator 310 advances the rod 308 fore and aft along the axis of rotation.

Figure 10:
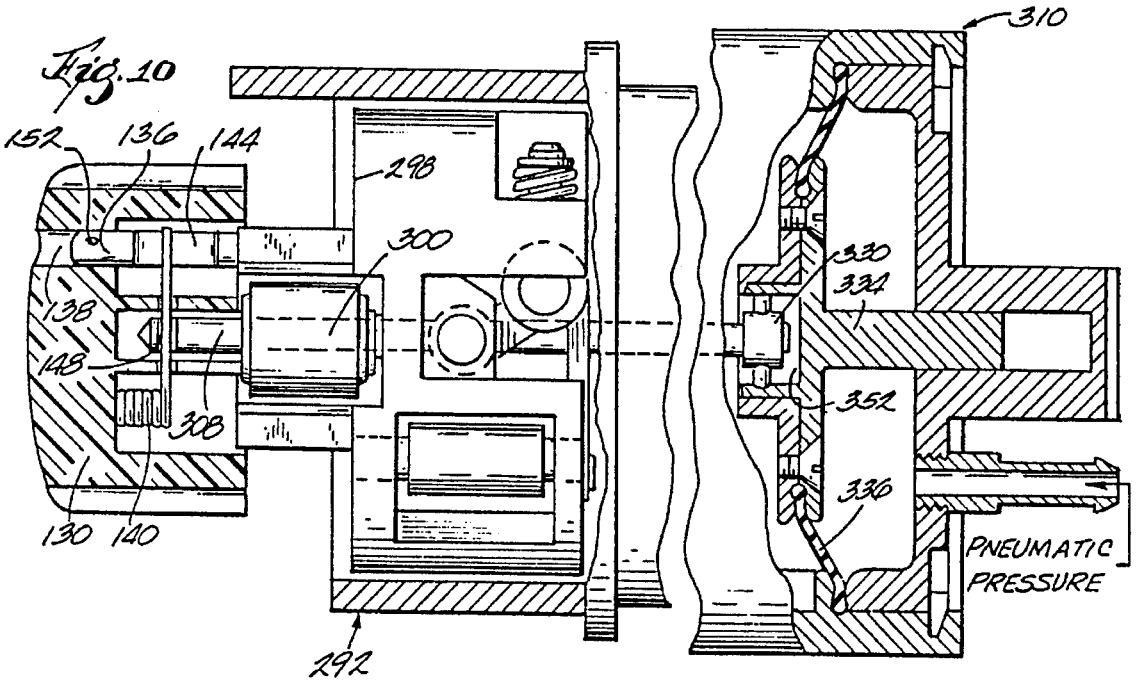
FIG. 10 is a side section view of the operation of the linear actuator to move the roller of the pump rotor assembly to their retracted position.
Figure 11:
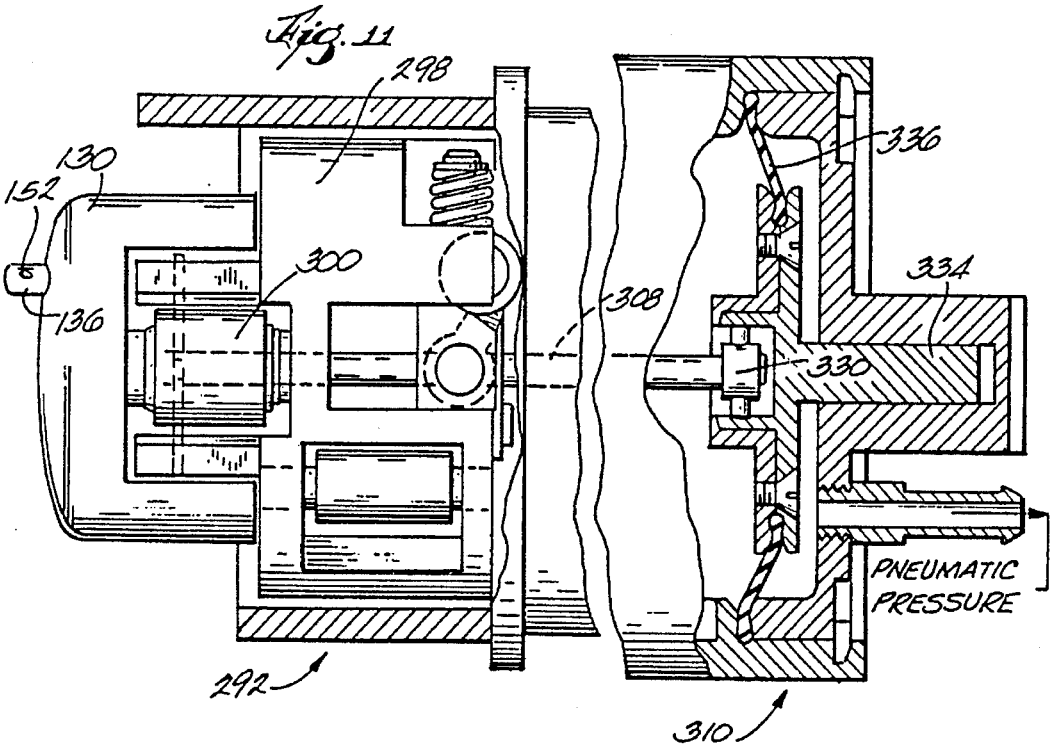
FIG. 11 is a side section view of the operation of the linear actuator to move the roller of the pump rotor assembly to their extended position.

As FIG. 1 also best shows, the distal end of the rod 308 extends into the center shaft 132 of the gripping handle 130. The distal end of the rod 308 includes a groove 148 that aligns with the handle shaft groove 142, so that the release spring 140 engages both grooves 142 and 148 when its free end rests against the relieved surface 144 (see FIG. 1A). In this arrangement (as FIGS. 10 and 11 show), aft sliding movement of the actuator rod 308 slides the handle 130 inward toward the rotor 298, thereby moving the rollers 300 into their extended positions. Forward movement of the actuator rod 308 slides the handle 130 outward from the rotor 298, thereby augmenting the spring-assisted return of the rollers 300 to their retracted positions.

The back end of the rotating actuator rod 308 passes through a thrust bearing 330 (see FIG. 1A). The thrust bearing 330 has an outer race 352 attached to a shaft 334 that is an integral part of the linear actuator 310.

In the illustrated embodiment (see FIGS. 10 and 11), the linear actuator 310 is pneumatically operated, although the actuator 310 can be actuated in other ways. In this arrangement, the actuator shaft 334 is carried by a diaphragm 336. The shaft 334 slides the handle outward (as FIG. 10 shows) in response to the application of positive pneumatic pressure, thereby retracting the rollers 300. The shaft 334 slides the handle inward (as FIG. 11 shows) in response to negative pneumatic pressure, thereby extending the rollers 300.

In the illustrated and preferred embodiment (see FIG. 1A), the actuator shaft 334 carries a small magnet 338. The actuator 310 carries a hall effect transducer 340. The transducer 340 senses the proximity of the magnet 338 to determine whether the shaft 334 is positioned to retract or extend the rollers 300. The transducer 340 provides an output to an external controller as part of its overall monitoring function.

Selectively retracting and extending the rollers 300 serves to facilitate loading and removal of the tubing 134 within the race 296. Selectively retracting and extending the rollers 300 when the rotor 298 is held stationary also serves a valving function to open and close the liquid path through the tubing 134. Further details of the features are set forth in copending application Ser. No. 08/175,204, filed Dec. 22, 1993 and entitled "Peristaltic Pump with Linear Pump Roller Positioning Mechanism", and copending application Ser. No. 08/172,130, filed Dec. 22, 1993, and entitled "Self Loading Peristaltic Pump Tube Cassette."

Figure 12:
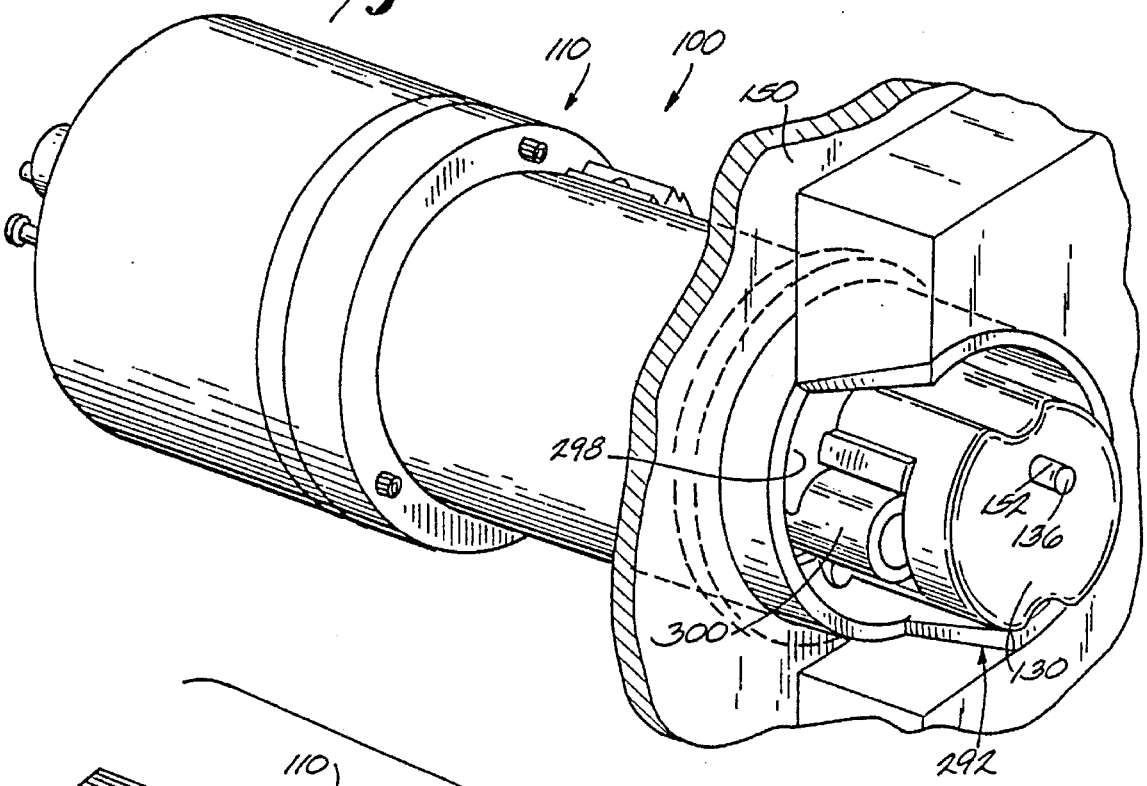
FIG. 12 is a perspective view of the pump installed in a work surface.

In a preferred embodiment, the pump 100 just described measures about 2.7 inches in diameter and about 6.5 inches in overall length, including the drive train assembly 110 and the pump rotor assembly 292. In use (as FIG. 12 shows), the pump 100 is mounted on a work surface 150, with the pump rotor assembly 292 exposed outside the work surface 150 and the drive train assembly 110 extending within the work surface 150.

Figure 13:
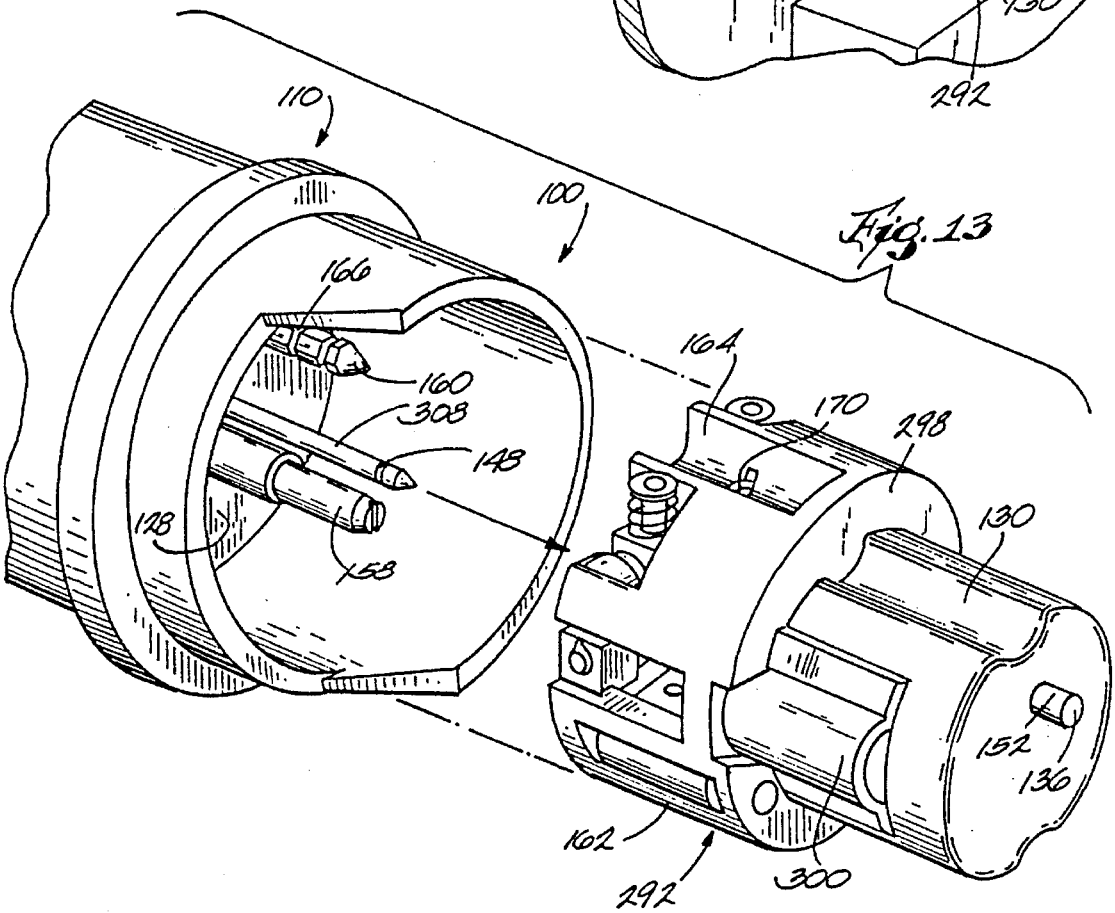
FIG. 13 is a perspective view of the pump installed in a work surface with the pump rotor assembly removed for repair or replacement.

In the unlikely event that tubing associated with or near the pump rotor assembly 292 leaks or ruptures, it may be necessary to clean or replace of the assembly 292. For this contingency, the pump 100 includes a quick release assembly that allows separation of the pump rotor assembly 292 from the drive train assembly 110, as FIG. 13 shows, and the subsequent reattachment of the same or replacement assembly 292, restoring the pump 100 back to the condition shown in FIG. 12.

As FIG. 14 shows, the previously described release bar 136 is rotatably mounted to the rotor 298 within the off-center handle bore 138. As FIG. 14 shows, the end of the release bar 136 is exposed when the handle 130 is in its inward position next to the rotor 298. The end includes a through hole 152. By inserting a rigid wire tool 154 through the hole 152, the user is able to rotate the release bar 136.

Rotation of the release bar 136 serves two simultaneous functions. First, it frees the distal end of the linear actuator rod 308 from the center shaft 132 of the gripping handle 130. Second, it frees the pump rotor assembly 292 from the carrier 128. The accomplishment of these functions allow separation of the pump rotor assembly 292 from the carrier 128.

Regarding the first release function (see FIGS. 15A and B), rotation of the release bar 136 moves the relieved surface 144 out of contact with the release spring 140. Rotation brings the opposite side surface 156 of the release bar 136 into contact with the release spring 140, as FIG. 15B shows. The opposite side surface 156 of the release bar 136 is not relieved. It is generally cylindrical in cross section, being radially spaced farther from the axis of the release bar 136 than the flat relieved surface 144. Thus, as the release spring 140 rides along the opposite side surface 156, it is lifted away from and out of the groove 148 on the distal end of the rod 308, thereby freeing the rod 308 from the handle 130.

Still, the opposite side surface 156 of the release bar 136 does not lift the release spring 140 completely out of the groove 142 in the handle shaft 132. Therefore, the release spring 140 is still captured by the groove 142 and continues to couple the handle 130 to the pump rotor assembly 292, even when the release bar 136 has been rotated to free the actuator rod 308.

Regarding the second release function (see FIGS. 1B and 13), the pump rotor assembly 292 is registered on two dowel pins 158 and 160 on the carrier 128 of the drive train assembly 110. The pump rotor assembly 292 includes a pair of mating rest surfaces 162 and 164 that abut, respectively, against the dowel pins 158 and 160 when the rotor assembly 292 sits against the carrier 128.

As FIG. 13 also show, one of the dowel pins 160) includes a groove 166 on its distal end. The pump rotor assembly 292 includes a pawl 168 having an exposed edge 170 that projects from the mating rest surface 164. The exposed pawl edge 170 engages the groove 166 of the dowel pin 160 to secure the rotor assembly 292 to the carrier 128.

As FIGS. 16A and 16B best show, the pawl 168 is attached to the release pin 136 for movement in response to rotation of the release pin 136. Rotation of the release pin 136 in one direction moves the pawl edge 170 outside the rest surface 164 for engaging the dowel pin groove 166 (as FIG. 16A shows). Rotation of the release pin 136 in the opposite direction moves the pawl edge 170 out of the rest surface 164 and into the confines of the rotor assembly 292 (as FIG. 16B shows). In the illustrated and preferred embodiment (as FIGS. 16A and B show), a spring 172 biases the position of the pawl 168 to normally expose the pawl edge 170.

When the release pin 136 is positioned as shown in FIG. 15A to lock the release spring 140 into the groove 148 of the actuator rod 308, the pawl 168 is likewise positioned with its edge 170 exposed and locked within the groove 166 of the dowel pin 160, as shown in FIG. 16A. With both grooves 148 and 166 engaged, the rotor assembly 292 is secured to the carrier 128 for operation (as FIG. 12 shows).

When the release pin 136 is positioned as shown in FIG. 15B to free the release spring 140 from the groove 148 of the actuator rod 308, the pawl 168 is likewise positioned with its edge 170 withdrawn free of the groove 166 of the dowel pin 160, as shown in FIG. 16B. With both grooves 148 and 166 disengaged, the rotor assembly 292 can be separated from carrier 128 for repair or replacement (as FIG. 13 shows).

To secure the same or replacement rotor assembly 292 on the carrier 128, the user places the release pin 136 in the position shown in FIGS. 15B/16B. Aligning the rest surfaces 162 and 164 with the appropriate dowel pins 158 and 160, while also aligning the actuator rod 308 with the handle shaft 132, the user slides the assembly 292 into position on the carrier 128. The user than rotates the release pin 136 to the position shown in FIGS. 15A/16A to engage the actuator rod 308 and the dowel pin 160, securing the pump rotor assembly 292 in place for operation.

Various features of the invention are set forth in the following claims.

We claim:

1. A peristaltic pumping apparatus comprising a peristaltic pumping element including a pump rotor carrying a roller, a drive mechanism for rotating the rotor and including a carrier for holding the pump rotor, and a handle on the pump rotor, first linkage coupling the pump roller and the handle to move the pump roller between a retracted position free of contact with pump tubing and an extended position making operative contact with pump tubing in response to displacement of the handle by manual force applied by a user, a mechanical actuator within the carrier adapted to be coupled to the handle to mechanically displace the handle, and thereby move the pump roller between the retracted position and the extended position, in response to a command signal, and a release pin mechanism carried on the pump rotor and exposed to access by the user, the release pin mechanism being movable by the user between a connect position that concurrently connects the pump rotor to the carrier and the handle to the mechanical actuator, a first release position that concurrently connects the pump rotor to the carrier while disconnecting the handle from the mechanical actuator, and a second release position that concurrently disconnects the pump rotor from the carrier and disconnects the handle from the mechanical actuator to allow separation of the pump rotor, the first linkage, and the handle from the drive mechanism and the mechanical actuator.

2. A peristaltic pumping apparatus comprising a peristaltic pumping element including a pump rotor carrying a roller, a drive mechanism for rotating the rotor about an axis and including a carrier for holding the pump rotor, and a handle on the pump rotor movable along the axis between a first position and a second position, first linkage coupling the pump roller and the handle to move the pump roller between a retracted position free of contact with pump tubing when the handle is in the first position and an extended position making operative contact with pump tubing in response to displacement of the handle by manual force applied by a user toward the second position, a mechanical actuator within the carrier adapted to be coupled to the handle to mechanically displace the handle between the first and second positions, and thereby move the pump roller between the retracted position and the extended position, in response to a command signal, and a release pin mechanism carried on the pump rotor and exposed to access by the user only when the handle is displaced in the one of the first and second positions and not in the other one of the first and second positions, the release pin mechanism being movable by the user between a connect position that concurrently connects the pump rotor to the carrier and the handle to the mechanical actuator, a first release position that concurrently connects the pump rotor to the carrier while disconnecting the handle from the mechanical actuator, and a second release position that concurrently disconnects the pump rotor from the carrier and disconnects the handle from the mechanical actuator to allow separation of the pump rotor, the first linkage, and the handle from the drive mechanism and the mechanical actuator.

3. An apparatus according to claim 1 or 2 wherein the release pin mechanism rotates among the connect position, the first release position, and the second release position.

4. An apparatus according to claim 2 wherein the release pin mechanism includes means for exposing the release pin only when the handle is displaced in the second position.

* * * * *